United States Patent [19]

Rampton

[11] 4,056,998

[45] Nov. 8, 1977

[54] TONAL PITCH INDICATOR FOR A KETTLEDRUM

[76] Inventor: Roger H. Rampton, 229 Mallard, Las Vegas, Nev. 89107

[21] Appl. No.: 689,286

[22] Filed: May 24, 1976

[51] Int. Cl.[2] ..... G10D 13/04

[52] U.S. Cl. ..... 84/419

[58] Field of Search ..... 84/419, 411, 413

[56] References Cited

U.S. PATENT DOCUMENTS

| | | | |
|---|---|---|---|
| 355,971 | 1/1887 | Boulanger | 84/419 |
| 1,742,869 | 1/1930 | Mirfield | 84/419 |
| 3,163,075 | 12/1964 | Toperzer, Jr. | 84/419 |
| 3,163,076 | 12/1964 | White | 84/419 |
| 3,747,463 | 7/1973 | Hinger | 84/419 |

*Primary Examiner*—Stephen J. Tomsky
*Attorney, Agent, or Firm*—H. Ross Workman; J. Winslow Young

[57] ABSTRACT

A removable tonal pitch indicator for a kettledrum having a foot lever-actuated adjustably tensioned drumhead or tympanum. The indicator provides a visual indication of the tonal pitch of the tympanum and includes a reciprocally movable marker which is moved upwardly or away from the tympanist to indicate a higher pitch and downwardly or toward the tympanist to indicate a lower tonal pitch of the tympanum. The desired direction of movement of the marker is attained by enclosing a relatively stiff cable in a sheath. The cable is attached to the marker and is anchored below the lever device while the sheath cooperates between the indicator housing and the lever device. Sufficient curvature is provided in the sheath/cable combination so that the movement of the lever device changes the curvature of the sheath/cable combination thereby forcing the cable to move the marker in a direction counter to the movement of the lever device. The indicator apparatus includes a plurality of adjustable pointers on either side of the marker path to permit coordination between a desired tonal pitch and the position of the marker.

12 Claims, 4 Drawing Figures

TONAL PITCH INDICATOR FOR A KETTLEDRUM

BACKGROUND

1. Field of the Invention

This invention relates to an improved tonal pitch indicator mechanism for a tympanum of a kettledrum.

2. The Prior Art

Kettledrums are widely used in a variety of musical settings and are collectively known as tympani while the musician playing the same is known as a tympanist. The kettledrum is formed by tightly stretching a velum of suitable plastic material or calf skin as the tympanum over the open end of a hollow, hemispherical surface which is the "kettle". A fleshhoop engages the periphery of the tympanum and encircles the open end of the kettle an incremental distance below the lip of the kettle to form a collar. A counterhoop is placed over the collar in engagement with the fleshhoop. Tuning screws, and more recently, a foot pedal mechanism in combination with the tuning screws, is used to force the counterhoop against the fleshhoop in an adjustable manner to selectively alter the tension of the tympanum over the kettledrum and, therefore, the tonal pitch of the tympanum.

Conventionally, the desired tonal pitch of the kettledrum is obtained by the tympanist changing the tension on the tympanum while striking the same until the desired tonal pitch is heard. Skilled tympanists are aware that each kettledrum has its own peculiar tonal pitch characteristics. This is usually a result of the shape and size of the kettle and variations in the thickness and quality of the tympanum, particularly when calf skin is used as the velum. Furthermore, temperature and humidity changes encountered, including those between the beginning and end of a performance, are also known to cause changes in the tonal pitch of the kettledrum. Accordingly, it is also necessary for the tympanist to periodically readjust the tension on the tympanum to maintain the desired tonal pitch during a performance. The musical score will also frequently indicate a change of tonal pitch for the tympani thereby requiring the tympanist to selectively change the tension on the tympanum and, therefore, the tonal pitch of the kettledrum. However, adjustment of the tonal pitch of a kettledrum by the historical method of listening for the desired tonal pitch while changing the tension of the tympanum is undesirable, difficult and distracting, particularly during the performance of a musical score.

Tuning indicators have been provided in the art. For example, see U.S. Pat. Nos. 355,971; 3,163,075; and 3,163,076. However, each of these devices incorporate an arcuate dial pointer device which does not lend itself well to placement on either side of the kettledrum at the preference of the tympanist since changes reverse the direction the arcuate needle traverses the dial and causes confusion for the tympanist. Desirably, a tonal pitch indicator should have a marker which moves upwardly or away from the tympanist to indicate a higher tonal pitch and downwardly or toward the tympanist to indicate a lower tonal pitch. An arcuate dial does not accommodate this type of display. Furthermore, the mechanical linkages of these prior art devices can be adapted to different models of the kettledrum only with difficulty since each framework has a different configuration and dimensions.

Additionally, prior art tonal pitch indicators are, for the most part, permanently mounted to the kettledrum thereby interferring with the disassembly and shipment or storage of the kettledrum. This is particularly troublesome when the customary shipping container is not configurated to receive a kettledrum with a tonal pitch indicator permanently attached thereto.

It would, therefore, be an advancement in the art to provide a tonal pitch indicator for a kettledrum wherein the indicator is readily adapted to be removably attached to various modifications of the kettledrum. An even further advancement in the art would be to provide a tonal pitch indicator wherein a marker is movable linearly with a generally upward movement or movement away from the tympanist of the marker corresponding to an increase in the pitch and a generally downward movement or movement toward the tympanist corresponding to a lowering of the pitch of the kettledrum. Such an invention is disclosed herein.

BRIEF SUMMARY AND OBJECTS OF THE INVENTION

The present invention involves a removable tonal pitch indicator for a kettledrum which may be visually observed to provide a visual indication representative of the tonal pitch of a kettledrum. The indicator is removably attached to the kettledrum adjacent the tympanum and is actuated by a conventional foot-operated lever which is used to selectively adjust the tension on the tympanum. A sheath/cable combination is interconnected between the indicator and the lever and framework of the kettledrum and sufficient curvature is maintained to the sheath/cable combination to accommodate counter-directional movement of a marker in the indicator with respect to the lever. The sheath is attached between the lever and the indicator structure while the cable is interconnected between the movable marker and the framework below the lever. Movement of the lever alters the curvature of the cable/sheath combination forcing the cable and marker to be moved counter-directionally to the lever and/or sheath. Tuning of the kettledrum is facilitated by a plurality of independently movable indicia mounted on either side of the indicator in proximity to the movable marker and which are preset to each of the desired tonal pitch settings.

It is, therefore, a primary object of this invention to provide improvements in tonal pitch indicators for kettledrums.

Another object of this invention is to provide improvements in the method of providing a visual indication of the tonal pitch of a kettledrum.

An even still further object of this invention is to provide a removable tonal pitch indicator for a kettledrum which can be readily modified to accommodate placement of the indicator on various models of kettledrums.

One still further object of this invention is to provide a visual, tonal pitch indicator for a kettledrum wherein a movable marker travels upwardly or away from the tympanist to indicate an increase in tension on the tympanum and, correspondingly, an increase in the tonal pitch of the kettledrum while, conversely, moving downwardly or toward the tympanist to indicate a decrease in the tension on the tympanum and, correspondingly, thereby indicate a decrease in the tonal pitch of the kettledrum.

These and other objects and features of the present invention will become more fully apparent from the following description and appended claims taken in conjunction with the accompanying drawing.

DETAILED DESCRIPTION OF THE PREFERRED EMBODIMENTS

Figure 1:
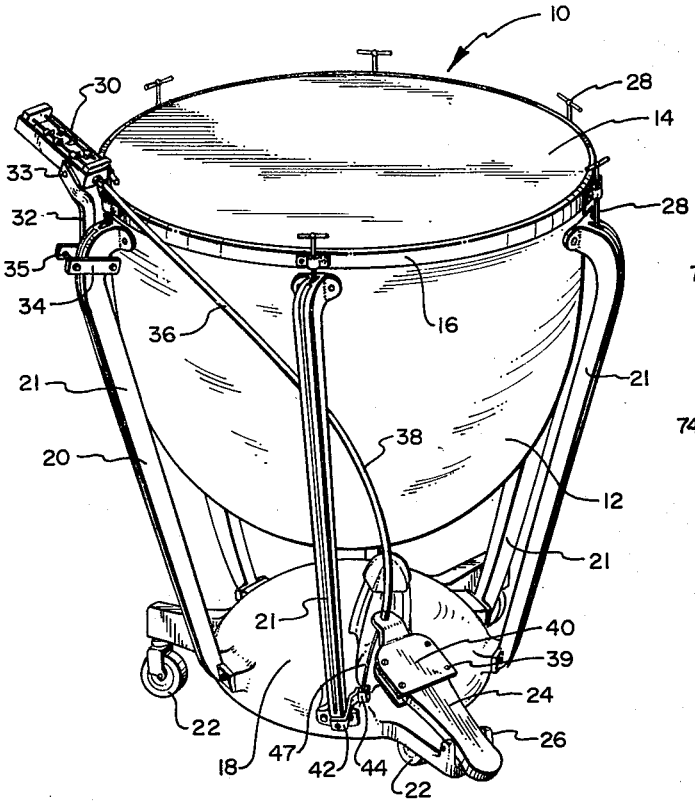
FIG. 1 is a perspective illustration of the tonal pitch indicator of this invention as it is attached to one model of a kettledrum having a first embodiment of a foot-actuated, tonal pitch adjustment lever.

The invention is best understood by reference to the drawing wherein like parts are designated with like numerals throughout.

Referring now to FIG. 1, a kettledrum is shown generally at 10 and includes the resonator cavity or kettle 12 over the open end of which the velum or tympanum 14 is stretched. The outer periphery of tympanum 14 is engaged by a fleshhoop (not shown) which is engaged by a counterhoop 16 for the purpose of imparting a predetermined tension on tympanum 14 as will be discussed more fully hereinafter.

Kettledrum 10 includes a framework 20 which, in the illustrated embodiment of FIG. 1, incorporates a pedestal 18 mounted upon a plurality of lockable wheels 22. Framework 20 is formed with a plurality of upright struts 21 which support kettle 12 and conceal mechanism cooperating between the foot pedal 24 and a plurality of T-screws 28 mounted upon counterhoop 16.

Foot pedal 24 is pivotally mounted at pivot 26 on pedestal 18 and is interconnected through the hidden mechanical linkage beneath pedestal 18 and through struts 21 to engagement with T-screws 28. As foot pedal 24 is depressed, the hidden linkage pulls downwardly on each of T-screws 28 causing counterhoop 16 to pull the fleshhoop (not shown) downwardly and stretch tympanum 14 more tautly over kettledrum 12 thereby raising the tonal pitch of the same. Conversely, release and elevation of foot pedal 24 relaxes some of the tension on tympanum 14 to, correspondingly, lower the tonal pitch of the same. Foot pedal 24 thereby serves to permit selective adjustment of the tension on tympanum 14.

Each of T-screws 28 may be individually tightened or loosened by hand. T-screws 28 may also be conventional drum rods which may also be individually operated by use of a conventional drum key (not shown) to provide an initial overall adjustment of the tension of tympanum 14 with respect to counterhoop 16. Additional information with respect to kettledrums may be found in a publication, DRUMS, by Charles L. White, the Sterling Press, Los Angeles, California (1960), Library of Congress catalog card No. 60-53596.

Figure 3:
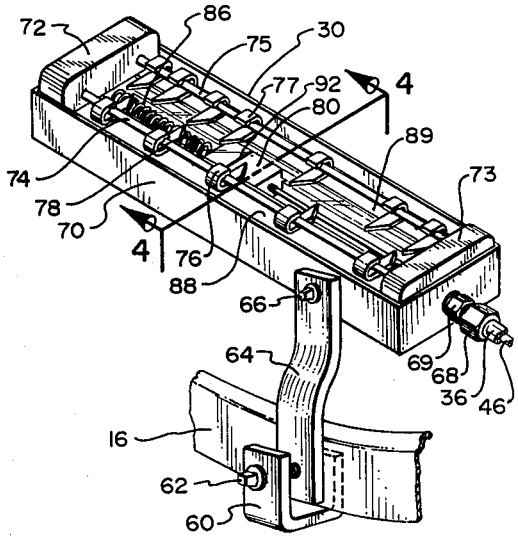
FIG. 3 is a perspective illustration of an enlargement of the tonal pitch indicator embodiment of this invention.

The indicator apparatus of this invention is shown generally at 30 and is releasably mounted adjacent tympanum 14 on the end of a brace 32. Brace 32 is releasably clamped to a strut 21 by means of clamp 34. Indicator 30 is selectively positioned with respect to kettledrum 10 and the tympanist (not shown) so that movement of marker 80 (see FIG. 3) is generally upward or away from the tympanist to indicate a higher tonal pitch and downwardly or toward the tympanist to indicate a lower tonal pitch. Vertical adjustment of indicator 30 is accommodated by a drum bolt 33 by which indicator 30 is secured to brace 32. Brace 32 is removably mounted on strut 21 by being clamped thereto with clamp 34. Drum bolts 35 and drum bolt 33 in clamp 34 each have a bolt head which is readily engageable by a conventional drum key (not shown) as will be discussed more fully hereinafter with respect to bolts 66 and 62 (FIG. 3). Accordingly, indicator 30 may be readily demounted from strut 21 for ease of storage and/or shipment of kettledrum 10 in a conventional kettledrum shipping container (not shown).

Figure 4:
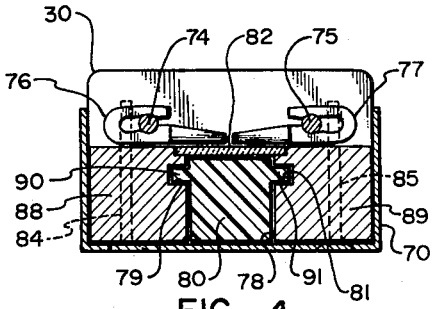
FIG. 4 is a cross section taken along lines 4—4 of FIG. 3.

Referring now more particularly to FIGS. 3 and 4, indicator 30 includes a housing 70 configurated as an elongated, rectangular open-top box in which are located two parallel, longitudinally oriented insert elements 88 and 89. Insert elements 88 and 89 are laterally spaced to form a longitudinal channel or slot 78 along the axis of housing 70. Each of spacing elements 88 and 89 include longitudinally extending opposed grooves 79 and 81 therein, respectively, in the side walls of slot 78. Marker 80 includes a pair of ears 90 and 91 (FIG. 4) which cooperate with grooves 79 and 81, respectively, to guide the movement of marker 80 along the longitudinal axis of slot 78. Slot 78 is covered with a transparent cover 82 (FIG. 4) which permits visual observation of a movable marker 80 therein while preventing the accumulation of dust and debris in slot 78 which would tend to interfere with movement of marker 80. Marker 80 includes a scribe line 92 thereon for the purpose of providing a more precise visual indication of relative movement of marker 80 in relation to indicia 76 and 77 as will be discussed more fully hereinafter.

Housing 70 further includes a pair of spaced, end blocks 72 and 73 at each end of housing 70. End blocks 72 and 73 receive a plurality of screws 84 and 85 (shown in broken lines, FIG. 4) and thereby securely retain spacing elements 88 and 89 within housing 70. Additionally, end blocks 72 and 73 engage the respective ends of stringers 74 and 75 and support the same a discrete distance above spacing elements 88 and 89, respectively. Stringers 74 and 75 are mounted adjacent slot 78 and support thereon a plurality of movable tone indicia 76 and 77, respectively.

Each tone indicia 76 and 77 is slidably adjustable with respect to its respective stringer along the length of slot 78. Indicia 76 and 77 are, selectively, imprinted with a preselected musical note so as to further assist the tympanist (not shown) in adjusting indicator 30. Preferentially, indicia 77 are each imprinted with a suitable musical note designation, universally recognized as the alphabetical letters A-G. Indicia 76 may, correspondingly, be imprinted with a conventional sharp symbol and thereafter be correlated with indicia 77 so as to provide a suitable sharp indication for each of the musical notes represented by indicia 77. These novel features permit the tympanist to selectively and separately orient each of indicia 76 and 77 with respect to marker 80, and more particularly, scribe line 92 thereon, to correlate the same with a particular tonal pitch obtained by selectively adjusting the tension on tympanum 14 (FIG. 1) according to conventional techniques.

Marker 80 is affixed to an end of a cable 46 which passes along the axis of slot 78. Reciprocal movement of cable 46 correspondingly moves marker 80 longitudinally along slot 78. A suitable spring 86 is also placed in slot 78 and cooperates between marker 80 and an end of housing 70. Selectively, spring 86 may be configurated as a tension or a compression spring and assists cable 46 in movement of marker 80 to compensate for frictional restraints encountered by cable 46.

In FIG. 3, indicator 30 is illustrated as supported on a truss 64 which is removably mounted upon counterhoop 16 by a U-clamp 60. This illustrated embodiment is a desirable alternative to the mounting embodiment illustrated in FIG. 1. U-clamp 60 is particularly configurated so as to receive a conventional drum bolt 62 in threaded relationship through one arm of U-clamp 60. The other arm of U-clamp 60 is slipped underneath a portion of counterhoop 16 and serves as an anvil to oppose the force exerted by the tightened drum bolt 62. The lower end of truss 64 is inserted between drum bolt 62 and counterhoop 16 and there secured by tightening bolt 62 to securely press strut 64 against counterhoop 16 and the anvil side of U-clamp 60. U-clamp 60 thereby provides a very secure engagement between truss 64 and counterhoop 16. In the illustrated embodiment, truss 64 is shown mounted generally vertical to the plane of counterhoop 16 although, clearly, other angular orientations of truss 64 could be readily obtained by loosening drum bolt 62 and placing truss 64 in the preselected angular orientation and thereafter securely tightening drum bolt 62.

A second drum bolt 66 passes through the upper end of truss 64 and engages a side wall of housing 70 so as to adjustably secure indicator 30 to the end of truss 64. Selectively, a conventional lock washer (not shown) may be placed on drum bolt 66 so as to be pressed between truss 64 and housing 70 to thereby inhibit rotational movement of indicator 30 about the axis formed by drum bolt 66.

Cable 46 is enclosed along a substantial portion of its length by a sheath 36. Sheath 36 is securely attached to housing 70 by means of a hollow bushing 69 and a cooperating bushing nut 68. Secure engagement of sheath 36 is obtained by the conventional technique of snugly encircling the end of sheath 36 with a ferrule (not shown) and thereafter clamping the ferrule between bushing 69 and bushing nut 68. Importantly, the lumen of sheath 36 is maintained through bushing 69, bushing nut 68, and the end of housing 70 so that cable 46 may be freely slidable therethrough.

Referring again to FIG. 1, sheath 36 traverses an arcuate path between indicator 30 and foot pedal 24. Selectively, sheath 36 is placed behind strut 21 so as to be unobtrusive. The lower end of sheath 36 is secured to a toe piece 40 which is releasably clamped to the end of foot pedal 24 by means of a plurality of screws 39. Importantly, sheath 36 and cable 46 therein (FIG. 3) traverse an arcuate path as indicated by curve 38 as will be discussed more fully hereinafter.

The lower end of cable 46 (FIG. 2) is encased in a stiffening tube 47 which imparts sufficient rigidity to cable 46 to inhibit binding of cable 46 as it is telescopically enclosed by sheath 36 upon movement of foot pedal 24. Stiffening tube 47 is secured to framework 20 at a position below foot pedal 24. In particular, a bracket 42 is bolted to strut 21 and has the end of stiffening tube 47 affixed thereto by means of a swivel 44.

In operation, as foot pedal 24 is depressed the lower end of the sheath 36 is moved downwardly over stiffening tube 47. Arcuate movement of the end of sheath 36 by the pivotal movement of foot pedal 24 about pivot 26 is compensated for by swivel 44 so as to further reduce the tendency for stiffening tube 47 to bind upon entry into sheath 36. The downward movement of the lower end of sheath 36 changes the curvature 38 of sheath 36 thereby accommodating relative movement of cable 46 counter-directionally to foot pedal 24 and sheath 36. Cable 46 imparts a pushing movement to marker 80. Correspondingly, raising of foot pedal 24 reverses the change in curvature 38 of sheath 36 causing stiffening tube 47 and cable 46 to be drawn outwardly therefrom with a resulting pulling movement of marker 80 by cable 46. Accordingly, as foot pedal 24 is depressed resulting in a tightening of the tension on tympanum 14 with a corresponding increase in tonal pitch, the marker 80 (FIG. 3) is pushed upwardly or away from the tympanist in an amount proportional to the movement of foot pedal 24. Conversely, raising of foot pedal 24 relaxes the tension on tympanum 14 thereby resulting in a lowering of the tonal pitch and causing a corresponding downward pulling movement or movement of marker 80 toward the tympanist in an amount proportional to the degree of movement of foot pedal 24. Of course, the direction of movement of marker 80 with respect to foot pedal 24 could easily be reversed by attaching the cable 46 at the top of the indicator 30.

Figure 2:
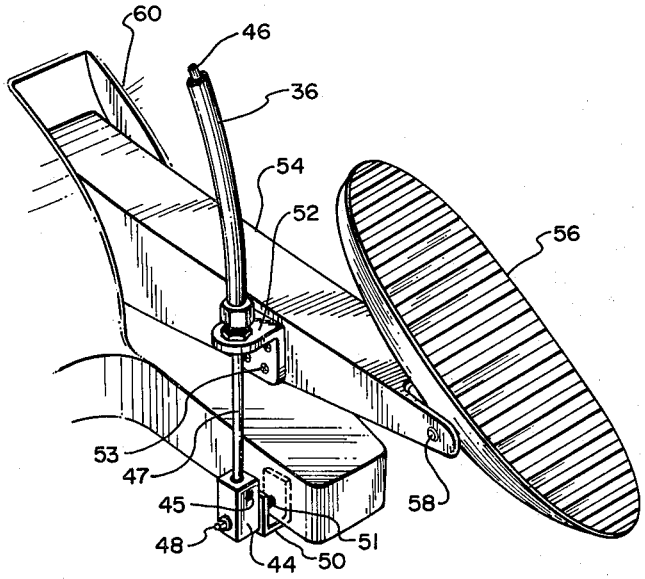
FIG. 2 is a perspective illustration of the sheath/cable combination in its attachment to a second embodiment of a foot-actuated lever for a second model of a kettledrum.

Referring now more particularly to FIG. 2, a second embodiment for the foot-actuated lever mechanism for a kettledrum is shown and includes a foot pedal 56 pivotally hinged to a lever 54 at a pivot point 58. Lever 54 is, in turn, mounted to a pedestal 60 and operates conventional hidden internal mechanism for selectively adjusting the tension on the tympanum 14 (FIG. 1) as discussed hereinbefore. However, instead of being attached directly to foot pedal 56, sheath 36 is affixed to lever 54 by means of a bracket 52 and a plurality of screws 53.

Cable 46 and, more particularly, stiffening tube 47, is affixed to pedestal 60 below lever 54 by means of a swivel 44 on a U-clamp 50. A drum bolt 51 is specifically designed to be tightened by means of a conventional drum key (not shown) which fits bolt head 48 and completes U-clamp 50. U-clamp 50 functions similarly to U-clamp 60 (FIG. 3) as discussed hereinbefore. U-clamp 50 thereby readily adapts attachment of cable 46 and stiffening tube 47 to a variety of pedestal types encountered in the various models of kettledrums. Cable 46 and stiffening tube 47 are attached to swivel 44 by means of a set screw 45. Swivel 44 compensates for the arcuate travel of bracket 52 when lever 54 is raised and lowered thereby reducing accidental binding of cable 46 and stiffening tube 47 with respect to movement into sheath 36.

According to the apparatus and method of the present invention, the tympanist selectively tunes the kettledrum 10 according to conventional techniques by selectively tightening one or more of T-screws 28 to achieve the desired overall tonal quality of tympanum 14. Thereafter, the tympanist depresses or raises one of foot pedal 24 or foot lever 54 until a desired tonal pitch is obtained corresponding to a preselected musical note. The tympanist then slidably adjusts the appropriate indicia 77 in alignment with scribe line 92 on marker 80. The tympanist again adjusts the tension on tympanum 14 with the foot pedal 24 or 56 according to conventional techniques until another preselected tonal pitch is obtained corresponding to another musical note at which time another indicia 77 is correlated with scribe line 92. The tympanist continues this selective adjustment of tympanum 14 for the full tonal range of the kettledrum 10. Selectively, the tympanist may also adjust indicia 76 in coordination with scribe line 92 on marker 80 so as to provide a suitable sharp indication for the particular musical note representation on the opposing indicia 77. The suitable adjustment of indicia 76 and 77 of indicator 30 correlates scribe line 92 on marker 80 with the appropriate musical note. Accordingly, the tympanist merely raises or lowers foot pedal 24 or foot lever 54 to move marker 80 counter-directionally thereto to align scribe line 92 with the preselected indicia 76 or 77. Pitch changes are accordingly, readily accomplished by visually observing the movement of marker 80 and scribe line 92 thereon until in alignment with the particular preselected indicia 76 or 77.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tonal pitch indicator for a kettledrum having a foot pedal for adjusting the tonal pitch thereof, the indicator comprising:

an elongated indicator housing;

a longitudinal slot in the housing visually observable from at least one side of the housing;

a marker longitudinally movable in the slot;

means for removably mounting the indicator housing to the kettledrum;

a hollow sheath interconnected between the indicator housing and the foot pedal means and having sufficient length to form an arcuate curvature between the indicator housing and the foot pedal means; and a cable connected to the marker and passing through the hollow sheath to an anchoring means beyond the end of the hollow sheath, a portion of the cable adjacent the foot pedal means being encased in a stiffening tube having sufficient stiffness to accommodate movement of the foot pedal means relative to the cable to telescopically enclose the cable with the sheath thereby changing the curvature of the sheath resulting in a relative movement of the cable and sheath to cause the cable to move the marker in the slot.

2. A tonal pitch indicator for a kettledrum comprising in combination a kettledrum having a drum head operable to be adjustably tensioned, a framework for supporting the kettledrum, foot-actuated means mounted upon the framework for adjustably tensioning the drumhead, the improvement comprising;

a tonal pitch indicator having a longitudinally movable marker therein, marker movement in a first direction coinciding with an increase in tension on the drumhead with a corresponding raising of the tonal pitch of the kettledrum and marker movement in a second direction coinciding with a decrease in tension on the drumhead with a corresponding lowering of the tonal pitch of the kettledrum, the indicator comprising:

an elongated housing adapted to be removably attached to the kettledrum framework;

a slot extending longitudinally in the housing and being viewable from at least one face of the housing;

a marker configurated to slidably move in the slot;

a cable attached at a first end to the marker and configurated to be removably attached at a second end to the framework by an attachment means; and a sheath for the cable, the sheath being attached at a first end to the housing and configurated to be removably attached at a second end to the foot-actuated means, the sheath being shorter than the cable, the sheath and cable combination having a length so as to form an arcuate path, movement of the foot-actuated means causing a change in the curvature of the arcuate path thereby accommodating telescopic movement of the cable within the sheath to move the marker within the slot.

3. A tonal pitch indicator as defined in claim 2 wherein the housing further includes a plurality of indicia adjustably mounted upon the housing adjacent the slot.

4. A tonal pitch indicator as defined in claim 2 wherein the housing further includes spring means in the slot and acting upon the pointer and the housing.

5. A tonal pitch indicator as defined in claim 2 wherein the second end of the sheath is removably attached to the foot-actuated means by a bracket which is secured directly to the foot-actuated means.

6. A tonal pitch indicator as defined in claim 2 wherein the foot-actuated means includes a foot pedal and the second end of the sheath is removably attached to the foot pedal by a clamp means.

7. A tonal pitch indicator as defined in claim 2 wherein the second end of the cable includes a swivel between the second end of the cable and the framework.

8. A tonal pitch indicator for a kettledrum comprising in combination a kettledrum having an adjustably tensioned tympanum, a framework for supporting the kettledrum, a foot pedal means attached to the framework and operable to adjustably tension the tympanum to selectively alter the tonal pitch of the kettledrum, the improvement comprising:

a tonal pitch indicator adapted to be removably mounted on the framework of the kettledrum, the indicator comprising:

an elongated housing;

means for removably mounting the housing to the kettledrum adjacent the tympanum;

a longitudinal slot formed in the housing and visible from at least one side of the housing;

a marker slidably operable in the slot, the pointer being visible from said one side of the housing;

a transparent cover for the slot;

spring means in the slot in cooperation between the housing and the pointer to resiliently urge the pointer toward a predetermined end of the housing;

an aperture in the housing and in registry with the slot;

a cable attached to the marker at a first end, passed through the aperture and attached at the second end to the framework at a position below the foot pedal means; and a sheath enclosing the cable and having a length shorter than the cable, the sheath being attached at a first end to the housing and at a second end to the foot pedal means, the sheath and cable traversing an arcuate path between the housing and the framework so as to provide sufficient curvature in the sheath to accommodate movement of the foot pedal means to correspondingly force the cable to be relatively displaced in the sheath thereby moving the marker in the slot, the marker thereby being moved counter-directionally to the foot pedal means.

9. A method for providing a visual indication of the tonal pitch of a kettledrum mounted upon a framework, the kettledrum having an adjustably tensioned tympanum and the framework supporting a foot pedal for adjustably tensioning the tympanum, the method comprising the steps of:

releasably mounting a tonal indicator on the kettledrum, the tonal indicator having an axially displaceable marker and a plurality of tonal indicia representing notes;

securing the marker of the tonal indicator to one end of a cable and associating the other end of the cable with a foot-actuated lever;

arcuately curving the cable between the indicator and the foot-actuated lever;

enclosing a portion of the length of the cable in a sheath, the length of the sheath being less than the length of the cable;

anchoring a first end of the sheath to the tonal indicator and a second end of the sheath to the foot-actuated lever;

displacing the marker with respect to the tonal indicia by moving the cable with the foot-actuated lever; and visually observing the position of the marker thereby obtaining a visual indication of the tonal pitch of the kettledrum.

10. A method as defined in claim 9 further comprising positioning the tonal indicia along at least one stringer, the position of the tonal indicia reflecting a predetermined note sounded by the kettledrum when the marker is aligned with the corresponding tonal indicia.

11. A method as defined in claim 9 further comprising continuously biasing the marker toward a predetermined location in the tonal indicator.

12. A method as defined in claim 9 further comprising adjusting the orientation of the tonal indicator with respect to the kettledrum to facilitate visual observation of the tonal indicator in any one of a plurality of positions.

* * * * *